US009266359B2

(12) United States Patent
Kondo et al.

(10) Patent No.: US 9,266,359 B2
(45) Date of Patent: Feb. 23, 2016

(54) PRINTER, PRINTER CONTROL METHOD, AND LIGHT IRRADIATION DEVICE

(71) Applicant: SEIKO EPSON CORPORATION, Tokyo (JP)

(72) Inventors: Takamitsu Kondo, Nagano (JP); Toru Takahashi, Nagano (JP); Hiroshi Wada, Nagano (JP); Kazuyoshi Tanase, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/324,597

(22) Filed: Jul. 7, 2014

(65) Prior Publication Data

US 2015/0062269 A1 Mar. 5, 2015

(30) Foreign Application Priority Data

Sep. 5, 2013 (JP) ..... 2013-183808

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 11/002; B41J 11/0015; B41J 2/01; B41M 7/0072; C09D 11/101
USPC ..... 347/102
See application file for complete search history.

(56) References Cited

U.S. PATENT DOCUMENTS

2007/0206083 A1* 9/2007 Hoshino ..... 347/102
2011/0242243 A1* 10/2011 Miyabayashi ..... 347/102
2012/0147080 A1* 6/2012 Kodaira ..... 347/17
2012/0287185 A1* 11/2012 Shimada ..... 347/9

FOREIGN PATENT DOCUMENTS

JP 2009-056695 A 3/2009

* cited by examiner

*Primary Examiner* — Manish S Shah
*Assistant Examiner* — Yaovi Ameh
(74) *Attorney, Agent, or Firm* — Global IP Counselors, LLP

(57) ABSTRACT

A printer or the like is provided that can increase adhesiveness between cured photo curable ink and a print medium as necessary. The printer includes a discharge unit 8 that discharges UV ink on a print medium S, an ultraviolet ray irradiation unit 15 that is set to a first mode in which, of a first light for curing the UV ink and a second light with higher curing properties than the first light, only the first light is irradiated on the print medium S on which the UV ink has been discharged, or a second mode in which at least the second light is irradiated, an adhesiveness information acquisition unit that acquires adhesiveness information related to ink adhesiveness which is adhesiveness between the UV ink and the print medium S when the UV ink is cured using the first light, and a control unit that sets the ultraviolet ray irradiation unit 15 to the second mode when the acquired adhesiveness information is designated information related to low ink adhesiveness.

8 Claims, 4 Drawing Sheets

PRINTER, PRINTER CONTROL METHOD, AND LIGHT IRRADIATION DEVICE

CROSS-REFERENCE TO RELATED APPLICATIONS

This application claims priority to Japanese Patent Application No. 2013-183808 filed on Sep. 5, 2013. The entire disclosure of Japanese Patent Application No. 2013-183808 is hereby incorporated herein by reference.

BACKGROUND

1. Technical Field

The present invention relates to a printer, a printer control method, and a light irradiation device for performing printing using photo curable ink.

2. Related Art

From the past, known are inkjet recording devices equipped with recording heads for discharging photo curable ink on a recording medium, and a light source for irradiating light that cures the photo curable ink on the recording medium on which the photo curable ink is discharged, making the irradiation volume for the ink of the background images which should be white or transparent lower than that of the irradiation volume for the ink of actual images (see JP-A-2009-056695 (Patent Document 1), for example).

SUMMARY

However, photo curable ink is fixed to the print medium by being cured using light, so basically, it is possible to record on any kind of material print medium. However, with conventional printers, depending on the print medium material, the ink or the like, even when photo curable ink is cured using light from the light irradiation unit, there are cases when it is not possible to obtain sufficient adhesiveness with the print medium. For example, when the print medium is formed from a material with an absorbent layer on the surface such as paper, the curing efficiency decreases due to infiltration of the polymerization initiator that is needed for curing or the like, and as a result, it is not possible to obtain sufficient adhesiveness with the print medium. When it is not possible to obtain sufficient adhesiveness between the cured photo curable ink and the print medium, for example, when tape that is adhered to a surface on which photo curable ink is cured (printed image) is peeled, it is easier for the photo curable ink of that part to also peel off together.

An object of the present invention is to provide a printer, a printer control method, and a light irradiation device capable of increasing the adhesiveness of cured photo curable ink and a print medium.

The printer of the present invention is equipped with a discharge unit that is configured to discharge photo curable ink on a print medium, a light irradiation unit that is configured to be set to a first mode in which, of a first light for curing the photo curable ink and a second light with higher curing properties than the first light, only the first light is irradiated on the print medium on which the photo curable ink has been discharged, and a second mode in which at least the second light is irradiated on the print medium on which the photo curable ink has been discharged, an adhesiveness information acquisition unit that is configured to acquire adhesiveness information related to ink adhesiveness which is adhesiveness between the photo curable ink and the print medium when the photo curable ink is cured using the first light, and a control unit that is configured to set the light irradiation unit to the second mode when the acquired adhesiveness information is designated information related to low ink adhesiveness.

The printer control method for the printer of the present invention is a printer control method for a printer having a discharge unit that is configured to discharge photo curable ink on a print medium, and a light irradiation unit that is configured to be set to a first mode in which, of a first light for curing the photo curable ink and a second light with higher curing properties than the first light, only the first light is irradiated on the print medium on which the photo curable ink has been discharged, or a second mode in which at least the second light is irradiated on the print medium on which the photo curable ink has been discharged, the printer control method including acquiring adhesiveness information related to ink adhesiveness which is adhesiveness between the photo curable ink and the print medium when the photo curable ink is cured using the first light, and setting the light irradiation unit to the second mode when the acquired adhesiveness information is designated information related to low ink adhesiveness.

With this constitution, by the light irradiation unit being set to the second mode when the acquired adhesiveness information is designated information relating to low adhesiveness, the second light which has higher curing properties than the first light is irradiated. By doing this, it is possible to increase the curing efficiency of the photo curable ink, and possible to increase the adhesiveness between the cured photo curable ink and the print medium. On the other hand, by setting the light irradiation unit to the first mode when the acquired adhesiveness information is not the designated information relating to low adhesiveness, since the second light is not irradiated, it is possible to suppress an increase in the energy consumption volume, for example the power consumption volume. In this way, it is possible to increase the adhesiveness between cured photo curable ink and the print medium as necessary.

With the aforementioned printer, the light irradiation unit has a first light irradiator that is configured to irradiate the first light, and a second light irradiator that is configured to irradiate the second light, and it is preferable for the control unit to set the light irradiation unit to the first mode by setting the second light irradiator to a non-irradiating state, and to set the light irradiation unit to a second mode by setting the second light irradiator to an irradiating state.

With this constitution, it is possible to switch the light irradiation unit between the first mode and the second mode using the simple control of switching the second light irradiator between the non-irradiating state and the irradiating state.

In this case, it is preferable that the discharge unit and the first light irradiator are provided on a device main unit, and that the second light irradiator is detachable with respect to the device main unit.

With this constitution, for example when it is not necessary to irradiate the second light, it is also possible to remove the second light irradiator and use this only with the device main unit with the discharge unit and the first light irradiator provided. Also, in this case, the device main unit size is smaller by the amount that the second light irradiator does not take up, so it is possible to install in a relatively small space.

In this case, the adhesiveness information acquisition unit is further configured to acquire a material of the print medium as the adhesiveness information, and it is preferable that the control unit is further configured to set the light irradiation unit to the second mode when the acquired material of the print medium is a designated low adhesiveness material for which the ink adhesiveness is low.

With this constitution, when the material of the print medium is a designated material with low ink adhesiveness, since the second light is irradiated, it is possible to increase the adhesiveness between the cured photo curable ink and the print medium. On the other hand, when the material of the print medium is not a designated material with low ink adhesiveness, if set to the first mode, the second light is not irradiated. By doing this when using various print media, it is possible to increase the adhesiveness between the cured photo curable ink and the print media as necessary.

In this case, it is preferable that even when the photo curable ink is clear ink and a print duty of the clear ink exceeds a designated value, the control unit is further configured to set the light irradiation unit to the second mode.

When performing high printing duty printing using clear ink that does not contain pigment as the photo curing agent, when the residual volume of polymerization initiator becomes greater because of insufficient light irradiation, since the polymerization initiator itself has color tone, the b* of the cured clear ink (print image) becomes large, specifically, there is a trend for the yellow tone to increase (turn yellow).

In contrast to this, with this constitution, even when the acquired adhesiveness information is not the designated information relating to low adhesiveness, when the photo curable ink is clear ink, and its print duty exceeds a designated value, by setting the light irradiation unit to the second mode, the second light is irradiated. By doing this, the reactivity of the polymerization initiator contained in the clear ink is increased, so it is possible to reduce the residual volume of the polymerization initiator, the b* of the cured photo curable ink (print image) becomes smaller, and it is possible to improve the yellowing level.

The light irradiation device of the present invention is equipped with a light irradiation unit that is configured to be set to a first mode in which, of a first light for curing photo curable ink and a second light with higher curing properties than the first light, only the first light is irradiated on a print medium on which the photo curable ink has been discharged, and a second mode in which at least the second light is irradiated on the print medium on which the photo curable ink has been discharged, an adhesiveness information acquisition unit that is configured to acquire adhesiveness information related to ink adhesiveness which is adhesiveness between the photo curable ink and the print medium when the photo curable ink is cured using the first light, and a control unit that is configured to set the light irradiation unit to the second mode when the acquired adhesiveness information is designated information related to low ink adhesiveness.

With this constitution, by setting the light irradiation unit to the second mode when the acquired adhesiveness information is the designated information relating to low adhesiveness, the second light which has higher curing properties than the first light is irradiated. By doing this, it is possible to increase the curing efficiency of the photo curable ink, and to increase the adhesiveness between cured photo curable ink and the print medium. On the other hand, if the light irradiation unit is set to the first mode when the acquired adhesiveness information is not the designated information related to low adhesiveness, the second light is not irradiated, so it is possible to suppress an increase in the power consumption volume. In this way, it is possible to increase the adhesiveness between the cured photo curable ink and the print medium as necessary.

In this case, it is preferable for the light irradiation device to be attachable to a printer having a discharge unit that is configured to discharge the photo curable ink on the print medium, and a first light irradiator that is configured to irradiate the first light on the print medium on which photo curable ink has been discharged such that the second light is irradiated on the print medium on which the photo curable ink has been discharged.

With this constitution, it is possible to attach the light irradiation device to the printer not equipped with the irradiator that irradiates the second light. By doing this, even with this kind of printer, it is possible to increase the adhesiveness between the cured photo curable ink and the print medium as necessary.

BRIEF DESCRIPTION OF THE DRAWINGS

Referring now to the attached drawings which form a part of this original disclosure.

DETAILED DESCRIPTION OF EMBODIMENTS

Following, we will describe the printer of one embodiment of the present invention while referring to the attached drawings. This printer performs printing using the inkjet method on a printing medium using UV ink (ultraviolet curing type ink). The printer is connected so as to be able to communicate with a host computer which is an external device, and performs printing based on the printing data sent from the host computer. The print medium is constituted by a long shaped sheet material, and various materials can be used such as paper, film or the like as described later.

Figure 1:
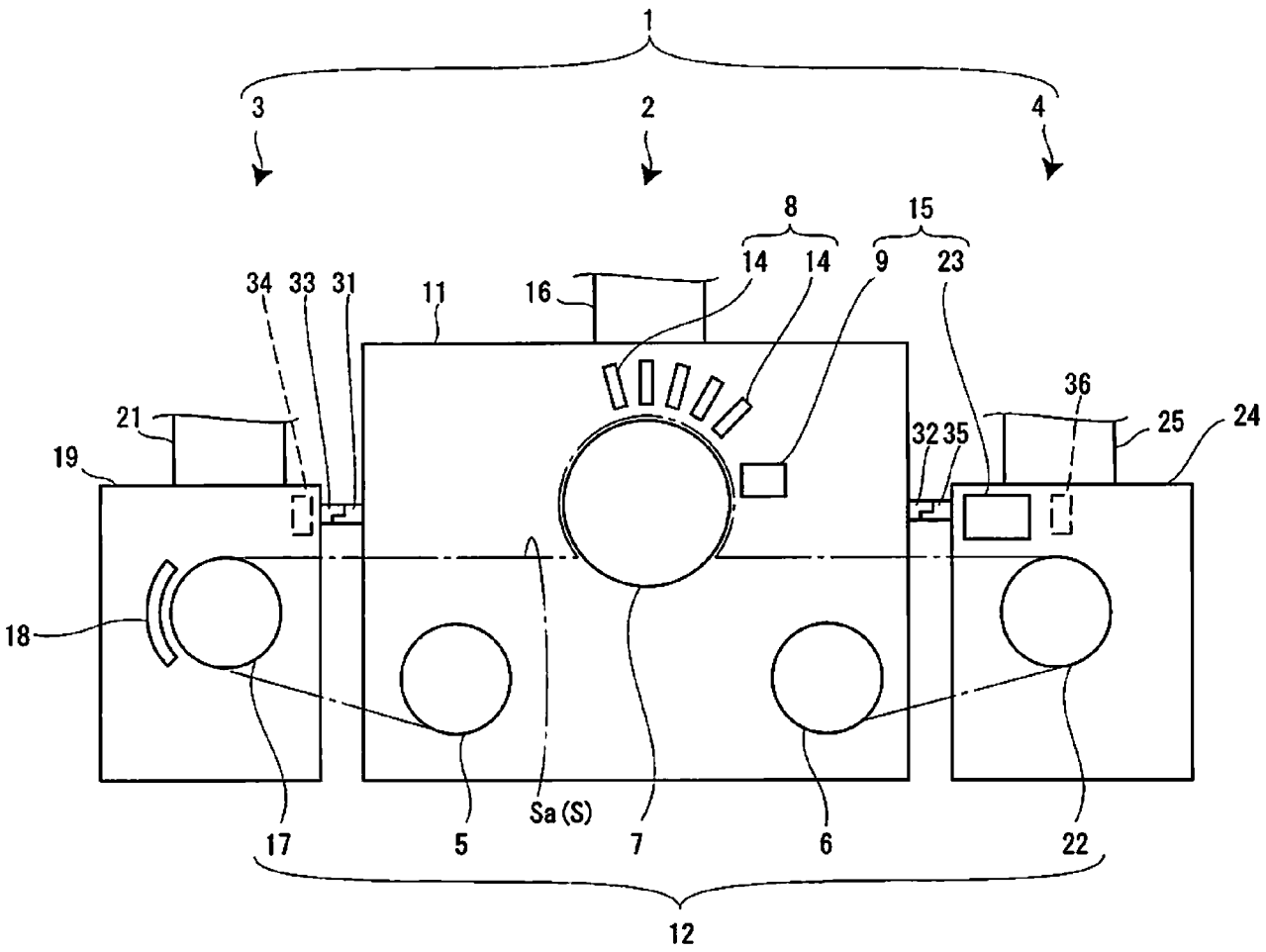
FIG. 1 is a configuration diagram of a printer of one embodiment of the present invention.

As shown in FIG. 1, a printer 1 is equipped with a device main unit 2, a corona treatment unit 3 provided on one side of the device main unit 2, and a strong irradiation unit 4 provided on the other side of the device main unit 2.

The device main unit 2 is equipped with a supply reel 5 provided nearer to the corona treatment unit 3, a take-up reel 6 provided nearer to the strong irradiation unit 4, a rotating drum 7 provided roughly in the middle of a feed path, a discharge unit 8 and an LED lamp 9 (Light Emitting Diode) provided so as to face opposite the circumference surface of the rotating drum 7, and a main unit cover 11 that accommodates these. On the device main unit 2, provided are a first main unit side coupling unit 31 that couples with a processing unit side coupling unit 33 (described later) of the corona treatment unit 3, and a second main unit side coupling unit 32 that couples with an irradiation unit side coupling unit 35 (described later) of the strong irradiation unit 4. Also, a control circuit substrate (not illustrated) constituting the control unit 28 described later is mounted on the device main unit 2.

The supply reel 5, the take-up reel 6, and the rotating drum 7, together with an upstream side folding roller 17 and a downstream side folding roller 22 described later, constitute a feed unit 12 that feeds a print medium S using a roll-to-roll method.

The supply reel 5 is rotated by a supply motor (not illustrated), and supplies the print medium S wound into roll form to the upstream side folding roller 17. The take-up reel 6 is rotated by a take-up motor (not illustrated), and takes-up the print medium S fed via the downstream side folding roller 22. The rotating drum 7 is a cylinder shaped drum supported so as to be able to rotate by a support mechanism (not illustrated), and the print medium S fed from the upstream side folding roller 17 to the downstream side folding roller 22 is supported from the back surface side, in other words, the side opposite to the printing surface Sa. The rotating drum 7 receives friction force with the print medium S, and does driven rotation in the feed direction of the print medium S, in other words, clockwise in FIG. 1.

The discharge unit 8 has a plurality of (e.g. five) inkjet heads 14 provided in radiating form in relation to the rotating drum 7. Each inkjet head 14 discharges UV ink onto the printing surface Sa of the print medium S fed at the circumference surface of the rotating drum 7. Of the five inkjet heads 14, four inkjet heads 14 on the feed direction upstream side discharge UV ink of mutually different colors (e.g. cyan, magenta, yellow, black), and the furthest downstream side inkjet head 14 discharges UV ink that does not contain a coloring material, in other words, clear ink. After a color image is formed on the printing surface Sa of the print medium S by the four upstream side inkjet heads 14, the clear ink is discharged by the furthest downstream side inkjet head 14 to give a gloss to the color image.

The LED lamp 9 (first light irradiator) and a high pressure mercury lamp 23 (second light irradiator) described later constitute an ultraviolet irradiation unit 15. As described later, the ultraviolet irradiation unit 15 is made to be able to choose between a first mode of irradiating ultraviolet rays only from the LED lamp 9 on the print medium S on which UV ink has been discharged, or a second mode of irradiating ultraviolet rays from both the LED lamp 9 and the high pressure mercury lamp 23. With the second mode, it is also possible to not have ultraviolet rays irradiated from the LED lamp 9, having ultraviolet rays irradiated only from the high pressure mercury lamp 23.

Also, in addition to the LED lamp 9 and the high pressure mercury lamp 23, it is also possible to provide a temporary curing irradiator for irradiating ultraviolet rays for temporary curing proximate to the feed direction downstream side of each inkjet head 14.

The LED lamp 9 is provided further to the feed direction downstream side than the discharge unit 8, and irradiates ultraviolet rays (first light) of a single wavelength (e.g. 395 nm). By the LED lamp 9 irradiating the first light on the printing surface Sa of the print medium S on which UV ink has been discharged, the UV ink is cured on the printing surface Sa, and is fixed or adhered to the printing surface Sa.

On the main unit cover 11 is connected a main unit duct 16 that allows the heat of reaction generated when the UV ink is cured to escape, and is also for recovering UV ink that became mist when discharged from the inkjet head 14.

The corona treatment unit 3 has an upstream side folding roller 17, a corona treater 18 provided so as to be along the circumference surface of the upstream side folding roller 17, and a corona unit cover 19 in which these are accommodated. Provided on the corona treatment unit 3 are a processing unit side coupling unit 33 coupled with the aforementioned first main unit side coupling unit 31, and a processing unit side cable connector 34 for electrically connecting with the aforementioned control circuit substrate.

The upstream side folding roller 17 changes the feed path so that the print medium S supplied from the supply reel 5 is fed toward the rotating drum 7.

The corona treater 18 selectively performs corona treatment (corona irradiation) on the printing surface Sa of the print medium S fed along the circumference surface of the upstream side folding roller 17. Specifically, the corona treater 18 is made to be able to choose between the treating state (ON) for performing corona treatment on the printing surface Sa of the print medium S, and the non-treating state (OFF) that does not perform corona treatment, and the control unit 28 described later (see FIG. 2) controls the corona treater 18 to switch between the treating state and the non-treating state according to the material of the print medium S. By corona treatment being performed on the printing surface Sa of the print medium S by the corona treater 18, the wettability of the printing surface Sa in relation to UV ink is enhanced.

A corona unit duct 21 is connected to the corona unit cover 19 to exhaust ozone generated by the corona treatment.

Also, the corona treatment unit 3 is constituted to be detachable in relation to the device main unit 2 by the processing unit side coupling unit 33 being coupled to the first main unit side coupling unit 31. Because of this, when it is not necessary to perform corona treatment such as when always using a print medium S that originally has high wettability, it is also possible to use this with the corona treatment unit 3 removed. Also, the overall size of the printer 1 is smaller by the amount not taken up by the corona treatment unit 3, so it is possible to install in a relatively small space. In this case, the feed path of the print medium S reaching from the supply reel 5 to the rotating drum 7 is changed as appropriate.

The strong irradiation unit 4 has the downstream side folding roller 22, the high pressure mercury lamp 23 provided further to the feed direction upstream side than the downstream side folding roller 22, and an irradiation unit cover 24 in which these are accommodated. Provided on the strong irradiation unit 4 are the irradiation unit side coupling unit 35 for coupling with the aforementioned second main unit side coupling unit 32 and an irradiation unit side cable connector 36 for electrically connecting with the aforementioned control circuit substrate.

The downstream side folding roller 22 changes the feed path so that the print medium S fed from the rotating drum 7 is fed toward the take-up reel 6.

The high pressure mercury lamp 23 is provided further to the feed direction downstream side than the aforementioned LED lamp 9, and irradiates ultraviolet rays (second light) having a broader wavelength spectrum and having higher energy than the LED lamp 9. Specifically, the second light irradiated by the high pressure mercury lamp 23 has higher curing properties for curing the UV ink than the first light irradiated by the LED lamp 9.

The high pressure mercury lamp 23 selectively irradiates the second light on the printing surface Sa of the print medium S fed from the device main unit 2. Specifically, the high pressure mercury lamp 23 is made to be able to choose between the irradiating state (ON) that irradiates the second light on the printing surface Sa on which UV ink has been discharged, and the non-irradiating state (OFF) that does not irradiate the second light, and the control unit 28 described later controls switching between the high pressure mercury lamp 23 irradiating state and the non-irradiating state according to the material of the print medium S or the like.

An irradiation unit duct 25 is provided on the irradiation unit cover 24 to exhaust ozone generated by ultraviolet irradiation.

Also, the strong irradiation unit 4 is constituted to be detachable with the device main unit 2 by the irradiation unit side coupling unit 35 coupling with the second main unit side coupling unit 32. Because of this, when irradiation of the second light by the high pressure mercury lamp 23 is not necessary, it is also possible to use this with the strong irradiation unit 4 removed. Also, the overall size of the printer 1 is smaller by the amount not taken up by the strong irradiation unit 4, so it is also possible to install in a relatively small space. In this case, the feed path of the print medium S from the rotating drum 7 to the take-up reel 6 is changed as appropriate.

To summarize the above, with the printer 1, the corona treater 18 performs corona treatment on the printing surface Sa of the print medium S supplied from the supply reel 5 according to the material of the print medium S. The discharge unit 8 discharges UV ink on the printing surface Sa of the print medium S fed from the corona treatment unit 3. Also, the LED lamp 9 irradiates the first light on the print medium S on which UV ink has been discharged. Furthermore, the high pressure mercury lamp 23 irradiates the second light on the print medium S fed from the device main unit 2 according to the material of the print medium S or the like. The take-up reel 6 winds up the already printed part of the print medium S for which a series of printing processes has been implemented in this way.

Figure 2:
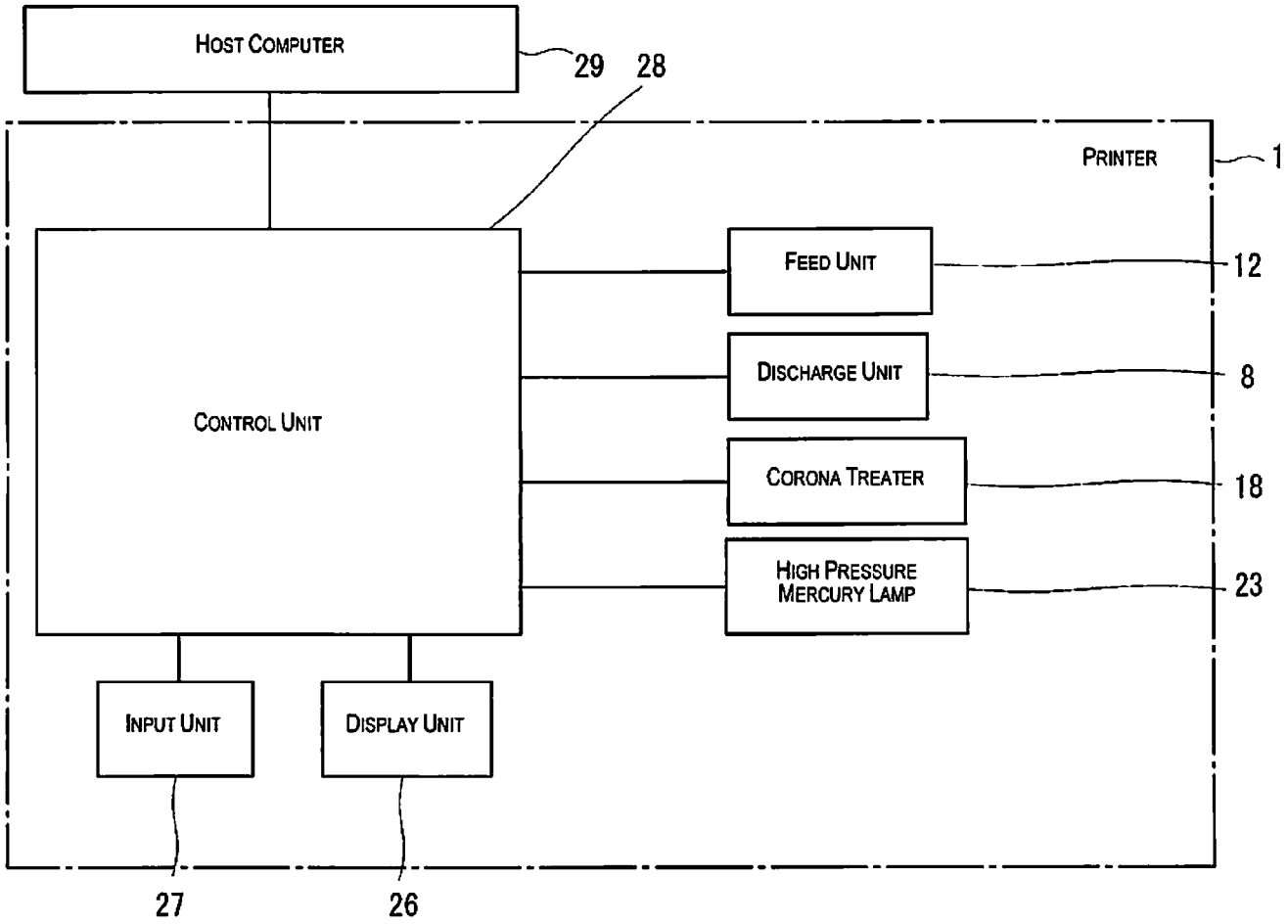
FIG. 2 is a block diagram of the printer.

We will describe the control system of the printer 1 while referring to FIG. 2. The printer 1 is equipped with a display unit 26, an input unit 27, and the control unit 28. Also, the operation of the printer 1 is controlled by a host computer 29 connected to be able to communicate.

The display unit 26 is constituted by a liquid crystal display or the like, for example, and displays a menu screen, error message or the like to an operator. The input unit 27 has selection buttons, setting buttons and the like, and receives input of various types of information from the operator. By the operator operating the input unit 27 while checking the display unit 26, the print setting screen is opened from the menu screen, and various types of information are input such as the material of the print medium S, the size of the print medium S, the type of UV ink or the like.

This information can also be input using an input unit such as a keyboard, mouse or the like provided on the host computer 29.

The control unit 28 is constituted from a CPU (Central Processing Unit), memory and the like. The control unit 28 controls each part of the printer 1 according to various types of information input from the input unit 27, or print data and various types of commands received from the host computer 29 or the like.

Here, we will give a detailed description regarding control of the corona treater 18 by the control unit 28. The control unit 28 controls whether to have the corona treater 18 set to the treating state or the non-treating state according to the material of the print medium S.

The material of the print medium S used with the printer 1 is roughly divided into paper and film. Paper includes cast-coated paper, semi-gloss paper and the like, and film includes PP film (polypropylene), PE film (polyethylene terephthalate), PE film (polyethylene) and the like.

Of these materials of the print medium S, there are many items for which the wettability of the printing surface Sa in relation to UV ink is low if corona treatment by the corona treater 18 is not performed for the cast-coated paper, semi-gloss paper, and PP film. When the wettability of the printing surface Sa is low, the UV ink discharged from the inkjet head 14 does not easily wet and spread on the printing surface Sa. Because of this, for example when printing a flat image, there is the risk of a patchy pattern occurring. Meanwhile, for PET film and PE film, even when corona treatment by the corona treater 18 is not performed, there are many items for which the wettability of the printing surface Sa in relation to UV ink is high.

In light of that, when the material of the input print medium S is a designated material of low wettability in relation to UV ink, specifically, when it is a designated low wettability material, the control unit 28 performs control to set the corona treater 18 to the treating state, and when it is not a designated low wettability material, sets the corona treater 18 to the non-treating state. With this embodiment, of the various materials of the print medium S noted above, cast-coated paper, semi-gloss paper, and PP film are designated low wettability materials.

Figure 3:
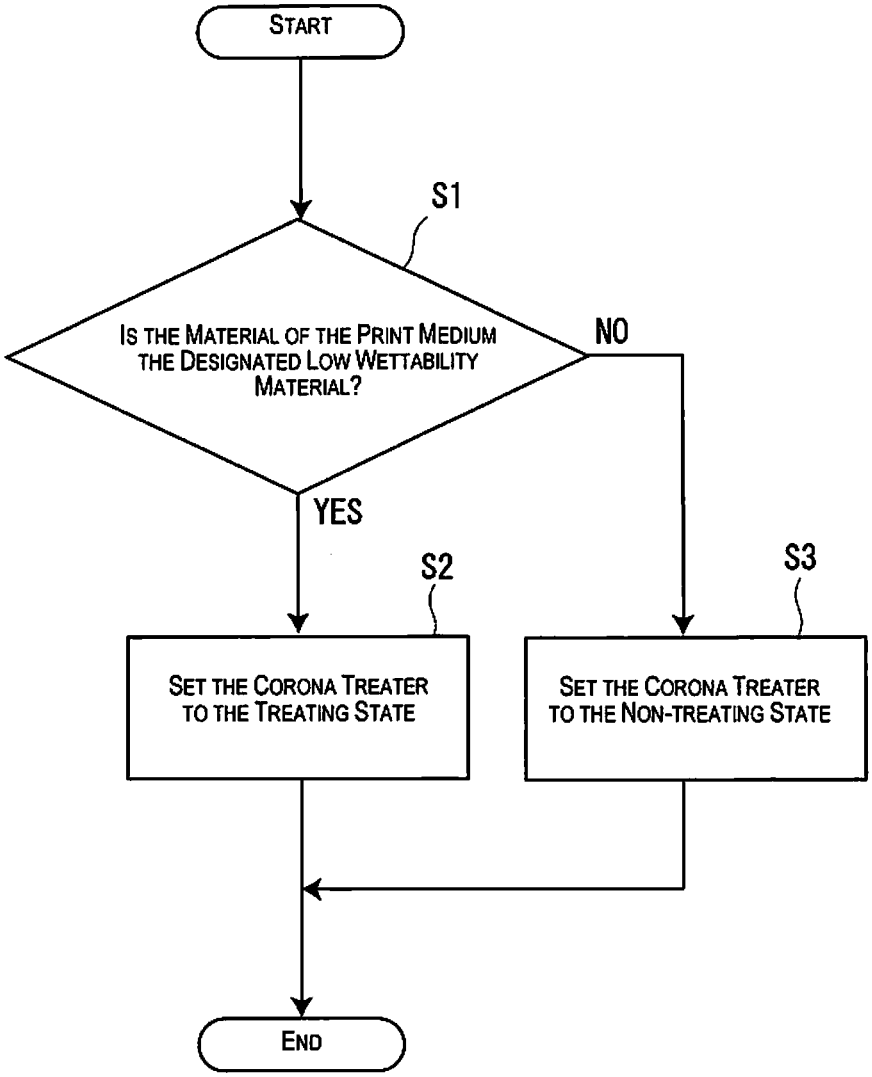
FIG. 3 is a flow chart showing the control of a corona treater with the printer.

As shown in FIG. 3, the control unit 28 judges whether or not the material of the print medium S input from the input unit 27 by the operator is a designated low wettability material, specifically, whether it is any of cast-coated paper, semi-gloss paper, or PP film (S1).

When the control unit 28 determines that the material of the input print medium S is for example cast-coated paper, and that the material of the print medium S is a designated low wettability material (S1: Yes), it sets the corona treater 18 to the treating state (S2).

On the other hand, when the control unit 28 determines that the material of the input print medium S is for example PET film, and that the material of the print medium S is not a designated low wettability material (S1: No), it sets the corona treater 18 to the non-treating state (S3).

In this way, when the material of the acquired print medium S is a designated low wettability material with low wettability to UV ink as is the case with cast-coated paper, the printer 1 performs corona treatment, so it is possible to enhance the wettability of the printing surface Sa, and it is possible to discharge ink on the printing surface Sa for which wettability has been enhanced. On the other hand, when the material of the acquired print medium S is not a designated low wettability material for which the wettability to UV ink is low as with PET film, corona treatment is not performed, so it is possible to inhibit an increase in the power consumption volume. Therefore, even when using print media S of different materials, it is possible to perform wettability enhancement treatment as necessary.

With this embodiment, the control unit 28 has cast-coated paper, semi-gloss paper, and PP film as designated low wettability materials for which the wettability to UV ink is low, but it is possible to set any material to be the designated low wettability material. Specifically, it is possible to study the wettability of the printing surface Sa to UV ink for each material of the print medium S in advance, and as a result, to set materials for which wettability was low as the designated low wettability material.

With this embodiment, the printer 1 acquires the material of the print medium S by the operator inputting from the input unit 27, but the constitution for acquiring the print medium S is not limited to this. For example, it is also possible to provide an identifier indicating that material, for example a two dimensional code, on the print medium S, and to acquire the material of the print medium S by the printer 1 reading the identifier using a two dimensional code reader, for example.

Also, with this embodiment, as the adhesiveness information relating to the wettability of the printing surface Sa, the material of the print medium S was used, but the adhesiveness information is not limited to this. For example, it is also possible to use the type of UV ink as the wettability information. In this case, when the type of input UV ink is a designated type with low wettability, the control unit 28 sets the corona treater 18 to the treating state. Also, it is possible to use both the material of the print medium S and the type of UV ink as the wettability information. In this case, when the material of the input print medium S and the type of UV ink are a designated combination of low wettability, the control unit 28 sets the corona treater 18 to the treating state. Also, it is possible to use a numerical value indicating the wettability of the printing surface Sa to the UV ink, for example the contact angle, as the wettability information. In this case, when the input contact angle exceeds a designated value, for example, the control unit 28 sets the corona treater 18 to the treating state.

Furthermore, it is also possible to use the discharge pattern imaging results as the wettability information. Specifically, it is also possible to provide a scanner further to the feed direction downstream side than the discharge unit 8, and using that scanner, to image the discharge pattern formed by the discharge unit 8 discharging UV ink on the printing surface Sa for which corona treatment has not been performed, and to use those imaging results as the wettability information. Also, when the acquired imaging results indicate that the wettability is low, the control unit 28 sets the corona treater 18 to the treating state, and when it indicates that the wettability is high, it sets the corona treater 18 to the non-treating state.

For example, the discharge unit 8 forms a ruled line as the discharge pattern, and when the line thickness is found from those imaging results and the line thickness is smaller than a designated value, said another way, when the line is thin, the control unit 28 sets the corona treater 18 to the treating state. It is also possible to constitute this so that when the discharge unit 8 forms a flat image as the discharge pattern, when the image density dispersion value is found from those results, and the image density dispersion value is greater than a designated value, said another way, when a patchy pattern occurs, the control unit 28 sets the corona treater 18 to the treating state. Here, the image density dispersion value means the variation state of the image density for each pixel within a fixed surface area. In this way, by using the discharge pattern imaging results as the wettability information, it is possible to obtain adhesiveness information according to the actual wettability.

With this embodiment, as the light irradiation unit (wettability enhancement treatment device) for enhancing the wettability of the printing surface Sa of the print medium S, the corona treater 18 was used, but this is not limited to this, and for example it is also possible to use other treatment devices for enhancing wettability, such as a plasma treatment device, frame treatment device or the like, for example. However, the corona treater 18 is preferable in light of being low cost and having low energy consumption compared to other treatment devices.

Following, we will give a detailed description regarding the ultraviolet irradiation unit 15 by the control unit 28. The control unit 28 controls whether to set the high pressure mercury lamp 23 to an irradiating state or a non-irradiating state according to the material of the print medium S and the print duty of the clear ink. By doing this, the control unit 28 controls switching of the ultraviolet irradiation unit 15 between the first mode and the second mode.

Of the various materials of the print medium S noted above, for cast-coated paper, semi-gloss paper, and PP film, with only the first light being irradiated by the LED lamp 9 on the printing surface Sa on which UV ink is discharged, in many cases, it was not possible to obtain sufficient adhesiveness between the cured UV ink and the printing surface Sa. When it is not possible to obtain sufficient adhesiveness between the cured UV ink and the printing surface Sa, for example, when tape that is adhered to a surface on which cured UV ink, or said another way, a printed image is formed by fixing the UV ink on the print medium S, is peeled, it is easier for the UV ink on that part to peel off together. On the other hand, for PET film and PE film, in many cases, sufficient adhesiveness was obtained between the cured UV ink and the printing surface Sa with only the irradiation of the first light by the LED lamp 9.

Also, when performing high printing duty printing using clear ink that does not contain pigment, when the residual volume of polymerization initiator becomes greater because of insufficient ultraviolet irradiation, since the polymerization initiator itself has color tone, the b* of the cured clear ink, said another way, the printed image formed by fixing of clear ink on the print medium S, becomes large, specifically, there is a trend for the yellow tone to increase (turn yellow).

In light of that, when the material of the input print medium S is a designated material of low ink adhesiveness, specifically, when it is a designated low adhesiveness material, the control unit 28 performs control so as to set the high pressure mercury lamp 23 to the irradiating state, and when the clear ink print duty exceeds a designated value, it sets the high pressure mercury lamp 23 to the irradiating state. Ink adhesiveness means the adhesiveness of the UV ink and the print medium S when the UV ink is cured using the first light from the LED lamp 9. With this embodiment, of the various media of the print medium S noted above, cast-coated paper, semi-gloss paper and PP film are set as the designated low adhesiveness materials.

Figure 4:
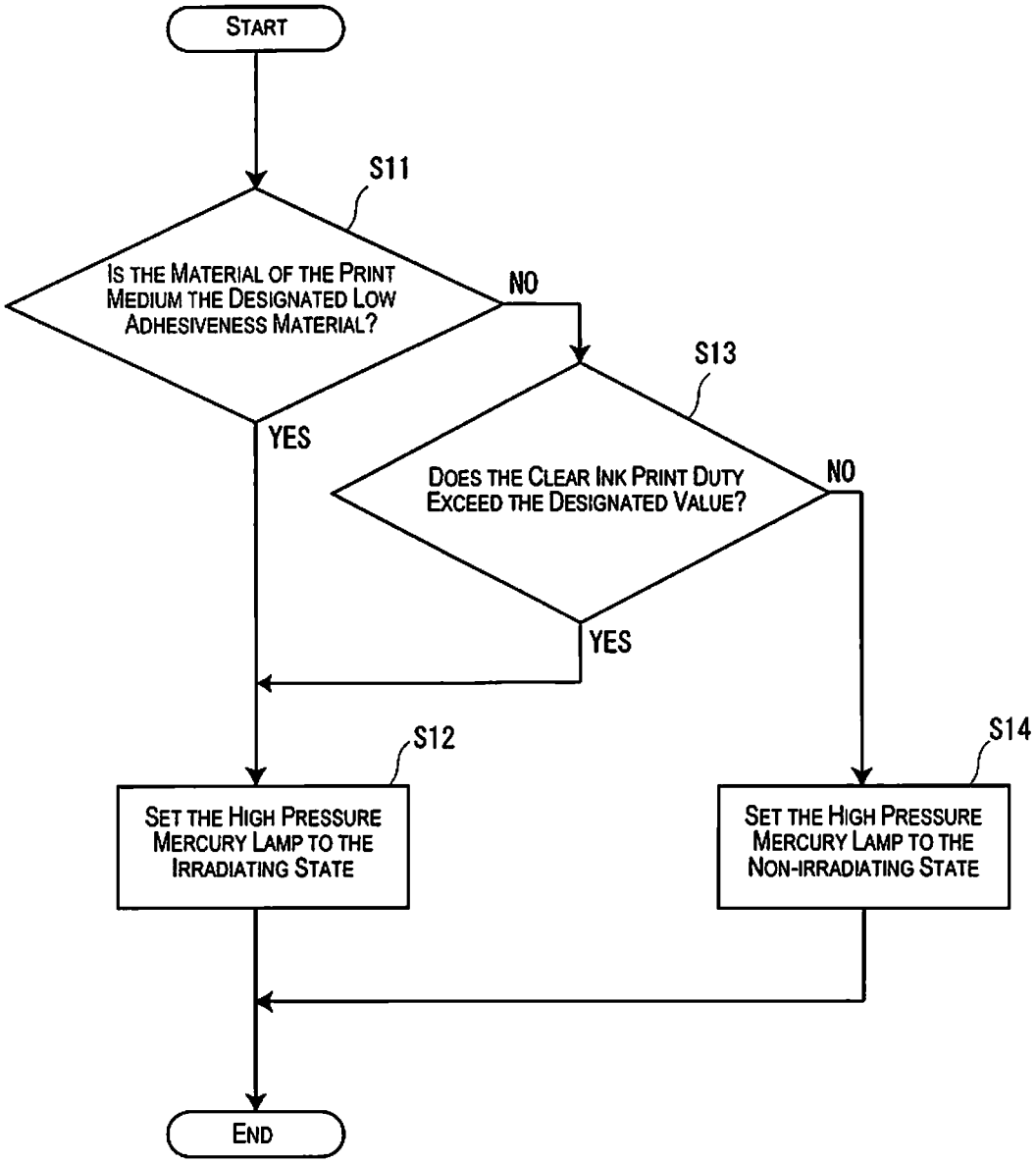
FIG. 4 is a flow chart showing the control of a high pressure mercury lamp with the printer.

As shown in FIG. 4, as the adhesiveness information, the control unit 28 determines whether or not the material of the print medium S input from the input unit 27 by the operator is the designated low adhesiveness material, specifically, whether or not it is any of cast-coated paper, semi-gloss paper, and PP film (S11). The material of the print medium S can also be acquired by reading an identifier provided with the print medium S using a reading device as described above.

When the control unit 28 determines that the material of the print medium S is for example cast-coated paper, and the material of the print medium S is a designated low adhesiveness material (S11: Yes), it sets the high pressure mercury lamp 23 to the irradiating state (S12).

On the other hand, when the material of the input print medium S is for example PET film, the control unit 28 determines that the material of the print medium S is not the designated low adhesiveness material (S11: No), and subsequently, determines whether or not the print duty of the clear ink exceeds a designated value (e.g. 60%) (S13). The clear ink print duty can be acquired from the clear ink print data or the like.

When the control unit 28 determines that the clear ink print duty exceeds a designated value (S13: Yes), it sets the high pressure mercury lamp 23 to the irradiating state (S12). On the other hand, when the control unit 28 determines that the clear ink print duty does not exceed a designated value (S13: No), it sets the high pressure mercury lamp 23 to the non-irradiating state (S14).

In this way, when the material of the print medium S is a designated low adhesiveness material with low ink adhesiveness such as with cast-coated paper, the printer 1 irradiates the second light using the high pressure mercury lamp 23, so it is possible to increase the adhesiveness of the cured UV ink and the print medium S. Also, even when the material of the print medium S is not the designated low adhesiveness material, when the clear ink print duty exceeds a designated value, the second light is irradiated by the high pressure mercury lamp 23. By doing this, the reaction volume of the polymerization initiator contained in the clear ink increases, so it is possible to reduce the residual volume of the polymerization initiator, the b* of the cured clear ink becomes smaller, and it is possible to improve the yellowing level. On the other hand, when the material of the print medium S is not the designated low adhesiveness material with low ink adhesiveness such as with PET film, and the clear ink print duty does not exceed a designated value, by not having the second light irradiated by the high pressure mercury lamp 23, it is possible to suppress an increase in the power consumption volume by the high pressure mercury lamp 23. Therefore, it is possible to irradiate the second light using the high pressure mercury lamp 23 as necessary.

With this embodiment, the control unit 28 uses cast-coated paper, semi-gloss paper, and PP film as the designated low adhesiveness material with low ink adhesiveness, but it is possible to set any material as the designated low adhesiveness material. Specifically, it is possible to study in advance the ink adhesiveness of the UV ink and the print medium S when the UV ink is cured using the first light from the LED lamp 9 for each material of the print medium S, and as a result, to set the material for which the ink adhesiveness was low as the designated low adhesiveness material. The ink adhesiveness can be measured using the UV ink curing rate, for example, specifically, the residual rate of light polymerizable compounds contained in the UV ink. The lower the residual rate of the light polymerizable compounds, the higher the curing rate of the UV ink.

With this embodiment, the designated low wettability material and the designated low adhesiveness material are the same, but of course it is not necessary to have these be the same.

With this embodiment, even if the material of the print medium S is not the designated low adhesiveness material, when the clear ink print duty exceeds a designated value, the second light was made to be irradiated by the high pressure mercury lamp 23, but when yellowing of the clear ink is not that much of a problem, when the material of the print medium S is not the designated low adhesiveness material, regardless of the clear ink print duty value, it is possible to have the second light irradiated by the high pressure mercury lamp 23. By doing this, it is possible to further suppress an increase in the power consumption volume by the high pressure mercury lamp 23.

With this embodiment, the ultraviolet irradiation unit 15 is constituted by the LED lamp 9 that irradiates the first light, and the high pressure mercury lamp 23 that irradiates the second light that has stronger curing properties than the first light, but as long as it is an item that irradiates ultraviolet rays of equivalent curing properties to these, it is also possible to use other ultraviolet irradiators. Furthermore, as long as it is an ultraviolet irradiator capable of selective irradiation of ultraviolet rays of the same curing properties as the first light and ultraviolet rays of the same curing properties of the second light, it is possible to constitute the ultraviolet irradiation unit 15 using a single ultraviolet irradiator.

As described above, with the printer 1 of this embodiment, when the acquired adhesiveness information is designated information relating to low adhesiveness, by having the high pressure mercury lamp 23 be set to the irradiating state, it is possible to have the second light with higher curing properties than the first light be irradiated from the LED lamp 9. By doing this, it is possible to increase the curing efficiency of the UV ink, and possible to increase the adhesiveness between the cured UV ink and the print medium S. On the other hand, when the acquired adhesiveness information is not the designated information related to low adhesiveness, by setting the high pressure mercury lamp 23 to the non-irradiating state, the second light is not irradiated from the high pressure mercury lamp 23, so it is possible to suppress an increase in power consumption volume. In this way, it is possible to increase the adhesiveness between the cured UV ink and the print medium S as necessary.

It is also possible to attach the ultraviolet ray irradiation device (light irradiation device) equipped with the aforementioned high pressure mercury lamp 23, the input unit 27, and the control unit 28 to the printer equipped with the discharge unit 8 and the LED lamp 9. In this case, this is attached so the second light from the high pressure mercury lamp 23 is irradiated on the print medium S on which UV ink has been discharged by the discharge unit 8. By doing this, it is possible to constitute the same kind of printer as the printer 1 of this embodiment.

Also, with this embodiment, UV ink was used, but other photo curable inks can be used. Furthermore, with this embodiment, the discharge unit 8 was constituted using inkjet heads 14, but it is also possible to have an item that discharges UV ink using another method.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A printer comprising:

a discharge unit configured to discharge photo curable ink on a print medium to form an image;

a light irradiation unit configured to be set to a first mode in which, of a first light for curing the photo curable ink and a second light with higher curing properties than the first light, only the first light is irradiated on the print medium on which the photo curable ink has been discharged, or a second mode in which at least the second light is irradiated on the print medium on which the photo curable ink has been discharged;

an adhesiveness information acquisition unit configured to acquire adhesiveness information related to ink adhesiveness which is adhesiveness between the photo curable ink and the print medium when the photo curable ink is cured using the first light; and a control unit configured to set the light irradiation unit to the second mode when the acquired adhesiveness information is designated information related to low ink adhesiveness such that a total light amount irradiated to the photo curable ink on an area of the print medium until completing the forming of the image on the area of the print medium is higher when the acquired adhesiveness information is the designated information related to the low ink adhesiveness than when the acquired adhesiveness information is designated information related to high ink adhesiveness that is higher than the low ink adhesiveness.

2. The printer according to claim 1, wherein the light irradiation unit has a first light irradiator that is configured to irradiate the first light, and a second light irradiator that is configured to irradiate the second light, and the control unit is further configured to set the light irradiation unit to the first mode by setting the second light irradiator to a non-irradiating state, and further configured to set the light irradiation unit to the second mode by setting the second light irradiator to an irradiating state.

3. The printer according to claim 2, wherein the discharge unit and the first light irradiator are provided on a device main unit, and the second light irradiator is detachable with respect to the device main unit.

4. The printer according to claim 1, wherein the adhesiveness information acquisition unit is further configured to acquire a material of the print medium as the adhesiveness information, and the control unit is further configured to set the light irradiation unit to the second mode when the acquired material of the print medium is a designated low adhesiveness material for which the adhesiveness is low.

5. The printer according to claim 1, wherein the control unit is further configured to set the light irradiation unit to the second mode even when the photo curable ink is clear ink and a print duty of the clear ink exceeds a designated value.

6. A printer control method for a printer having a discharge unit that is configured to discharge photo curable ink on a print medium, and a light irradiation unit that is configured to be set to a first mode in which, of a first light for curing the photo curable ink and a second light with higher curing properties than the first light, only the first light is irradiated on the print medium on which the photo curable ink has been discharged, or a second mode in which at least the second light is irradiated on the print medium on which the photo curable ink has been discharged, the printer control method comprising:

acquiring adhesiveness information related to ink adhesiveness which is adhesiveness between the photo curable ink and the print medium when the photo curable ink is cured using the first light; and setting the light irradiation unit to the second mode when the acquired adhesiveness information is designated information related to low ink adhesiveness such that a total light amount irradiated to the photo curable ink on an area of the print medium until completing the forming of the image on the area of the print medium is higher when the acquired adhesiveness information is the designated information related to the low ink adhesiveness than when the acquired adhesiveness information is designated information related to high ink adhesiveness that is higher than the low ink adhesiveness.

7. A light irradiation device comprising:

a light irradiation unit configured to be set to a first mode in which, of a first light for curing photo curable ink and a second light with higher curing properties than the first light, only the first light is irradiated on a print medium on which the photo curable ink has been discharged, and a second mode in which at least the second light is irradiated on the print medium on which the photo curable ink has been discharged;

an adhesiveness information acquisition unit configured to acquire adhesiveness information related to ink adhesiveness which is adhesiveness between the photo curable ink and the print medium when the photo curable ink is cured using the first light; and a control unit configured to set the light irradiation unit to the second mode when the acquired adhesiveness information is designated information related to low ink adhesiveness such that a total light amount irradiated to the photo curable ink on an area of the print medium until completing the forming of the image on the area of the print medium is higher when the acquired adhesiveness information is the designated information related to the low ink adhesiveness than when the acquired adhesiveness information is designated information related to high ink adhesiveness that is higher than the low ink adhesiveness.

8. The light irradiation device according to claim 7, wherein the light irradiation device is attachable to a printer having a discharge unit that is configured to discharge the photo curable ink on the print medium, and a first light irradiator that is configured to irradiate the first light on the print medium on which the photo curable ink has been discharged such that the second light is irradiated on the print medium on which the photo curable ink has been discharged.

* * * * *